US005148996A

United States Patent [19]

Fletcher et al.

[11] Patent Number: 5,148,996

[45] Date of Patent: Sep. 22, 1992

[54] ICE CRUSHER

[75] Inventors: Charles J. Fletcher, Sparta; Mark J. Fletcher, Vernon, both of N.J.

[73] Assignee: Clawson Machine Company, Franklin, N.J.

[21] Appl. No.: 593,897

[22] Filed: Oct. 5, 1990

Related U.S. Application Data

[63] Continuation-in-part of Ser. No. 533,358, Jun. 5, 1990, abandoned.

[51] Int. Cl.[5] ..... B02C 19/02

[52] U.S. Cl. ..... 241/36; 241/224; 241/243; 241/DIG. 17

[58] Field of Search ..... 241/152 A, 36, 154, 241/243, DIG. 17, 241, 239, 224

[56] References Cited

U.S. PATENT DOCUMENTS

| | | | |
|---|---|---|---|
| 821,927 | 5/1906 | Dale | 241/DIG. 17 X |
| 1,024,594 | 4/1912 | Nolan et al. | 241/DIG. 17 X |
| 2,593,874 | 4/1952 | Grandia . | |
| 2,643,065 | 6/1953 | Clawson | 241/DIG. 17 X |
| 2,645,910 | 7/1953 | Leeson | 241/DIG. 17 X |
| 3,602,441 | 8/1971 | Alvarez . | |
| 3,824,805 | 7/1974 | Prada . | |

*Primary Examiner*—Mark Rosenbaum
*Assistant Examiner*—Willmon Fridie, Jr.
*Attorney, Agent, or Firm*—Pollock, Vande Sande & Priddy

[57] ABSTRACT

An ice crushing apparatus for use in combination with an ice making machine which has an ice storage bin. The ice crusher includes a plurality of rotatable blades which are mounted on a motor-driven shaft and which pass, preferably in sequence, through slots in a grate, for crushing the ice in an ice crushing zone. A mechanism is provided for bypassing the ice crusher and dropping ice directly from the ice maker to the ice storage bin. A mechanism is also provided for moving the grate to change the size of crushed ice particles. In one embodiment, a device is provided for breaking apart large sheets or other chunks of ice before they reach the ice crushing zone. An electronic control system provides ice crusher operation only when ice is harvested in the ice making machine.

16 Claims, 9 Drawing Sheets

ICE CRUSHER

RELATED APPLICATION

This is a continuation-in-part of U.S. application Ser. No. 533,358 filed Jun. 5, 1990, now abandoned.

FIELD OF THE INVENTION

The present invention relates in general to apparatus for crushing ice, and relates more particularly to an ice crusher adaptable for use with an ice-making machine.

BACKGROUND OF THE INVENTION

Typical ice-making machines, such as are in use in hotels and other commercial ventures, consist of a refrigeration zone for freezing water into ice, and an insulated storage zone for accumulating and storing the resulting ice. The ice typically is produced in the form of a cube, a cylinder or a half disc, although ice in sheet form is produced by some ice makers. While the ice in the shapes and sizes as delivered from the ice maker is satisfactory for some purposes, crushed ice has some advantages because of its relatively small particles sizes which make its availability desirable. However, the known ice machines in use in hotels and other public places do not supply crushed ice.

SUMMARY OF THE INVENTION

It is accordingly one object of this invention to provide apparatus for crushing ice wherein the crushing apparatus is adapted for use with a wide variety of ice makers, including those used in hotels and motels. Other objects of this invention are to provide an ice crusher which can be mounted between a conventional ice maker and its ice storage zone, which has means for optionally bypassing the ice crushing step, and which also may include means for changing the particle size of the crushed ice.

In accordance with this invention, there is provided an ice crusher for placement between an ice maker having ice outlet means and an ice storage bin having ice inlet means, wherein the ice crusher comprises: housing means including a pair of vertically-extending opposed sidewalls, a pair of opposed end walls secured to said sidewalls, upper ice inlet means for communicating with the ice outlet means of the ice maker, and lower crushed ice outlet means for communicating with the ice inlet means of the ice storage bin; a crusher assembly mounted within the housing comprising a horizontally-extending crusher rotor mounted on and perpendicular to the sidewalls, a plurality of spaced-apart ice striking elements extending radially from the rotor, and a grate member mounted within the housing and having a row of spaced-apart fingers defining therebetween open-ended slots for cooperating with the ice striking elements to crush ice; means for directing ice from the ice inlet means to the crusher assembly; a selector means pivotally mounted on the sidewalls of the housing for directing ice from the ice maker either to the crusher assembly or directly to the ice storage bin; and drive means for rotating the crusher rotor.

There may also be provided means for adjusting the position of the grate member to change the spacing between the open-ended slots and the ice striking elements, and thereby change the particle size of the crushed ice. Where the ice maker forms sheets of ice instead of ice pieces, the ice crusher may include breaker means for breaking up the sheets into smaller pieces before the ice reaches the crushing elements.

The resulting ice crusher is particularly well-suited for incorporation as a module between a conventional ice making machine and its associated ice storage bin. The ability to bypass the ice crushing elements and introduce the ice directly from the ice maker to the storage bin is particularly useful, as is the feature for changing the relative position of the ice striking elements with respect to the grate member in order to change the particle size of the crushed ice.

BRIEF DESCRIPTION OF THE DRAWINGS

The invention is further described in the detailed description below taken in conjunction with the accompanying drawings in which.

DETAILED DESCRIPTION OF THE INVENTION

The best mode embodiments of the ice crusher of the present invention are described below in detail in combination with typical commercially available ice makers which are provided with ice storage bins.

Figure 1:
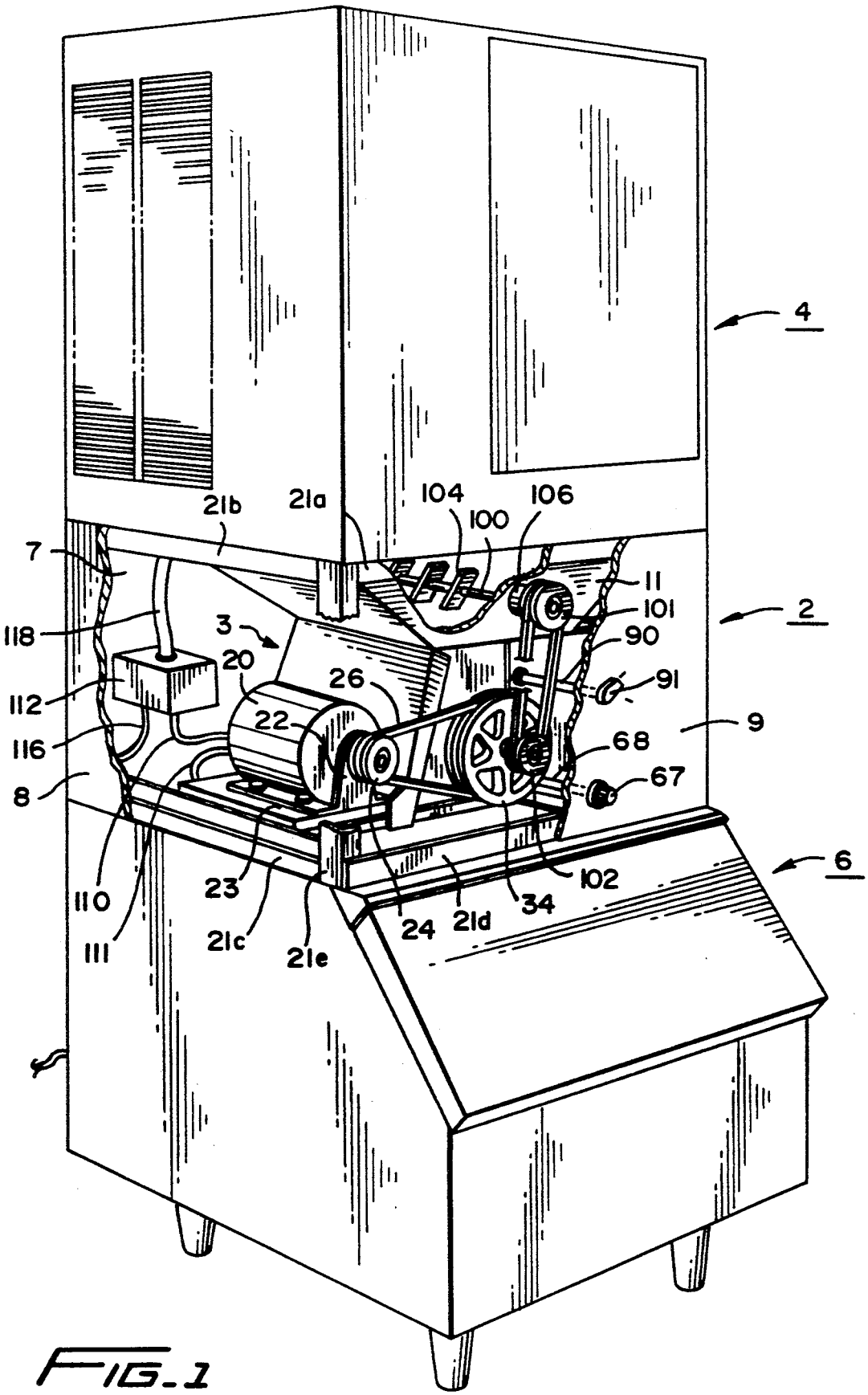
FIG. 1 is a view in perspective, and partially cut away, showing the ice crusher of the present invention in combination with an ice maker and an ice storage bin.
Figure 2:
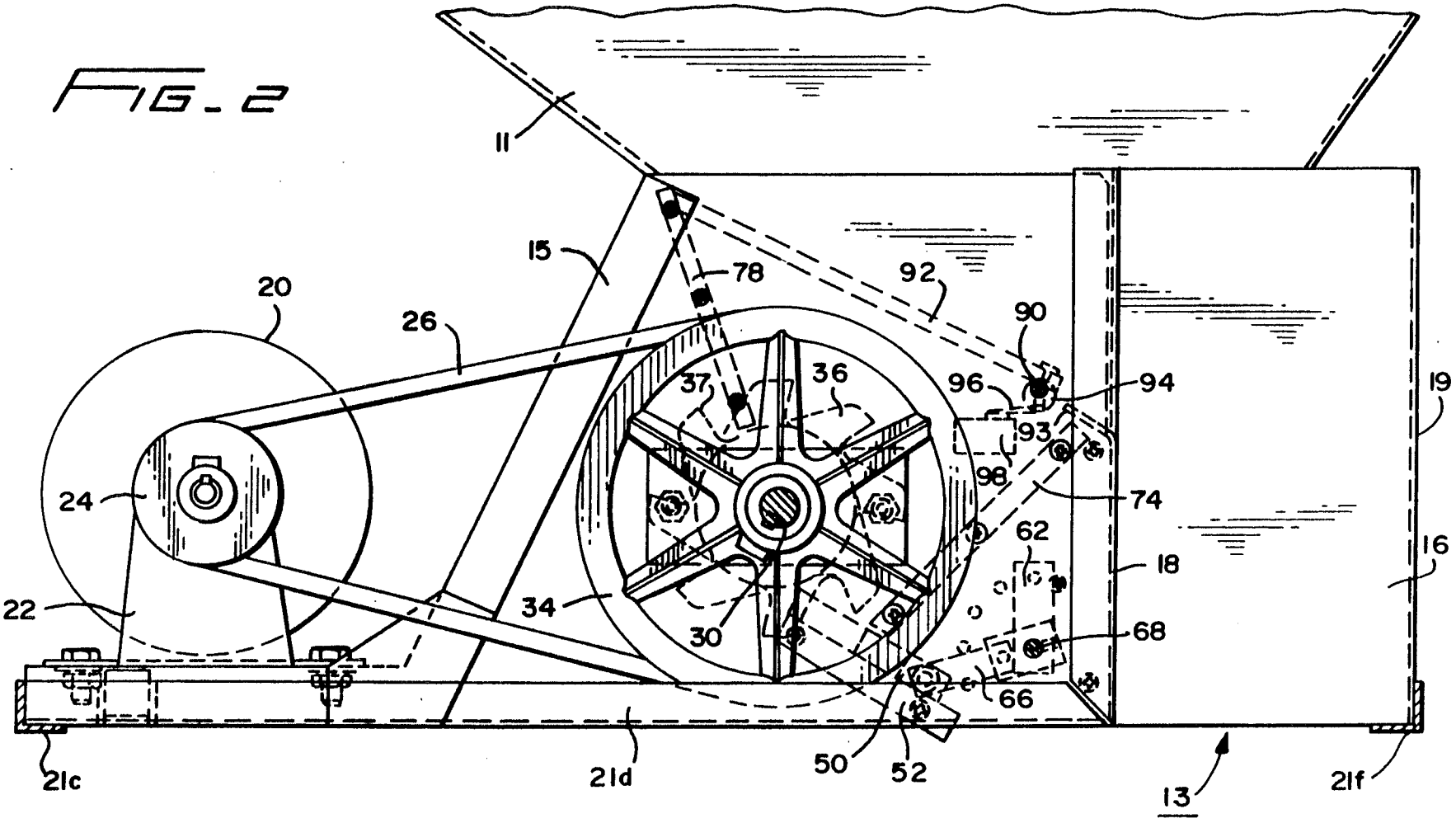
FIG. 2 is an elevational view of the ice crusher of the present invention.
Figure 4:
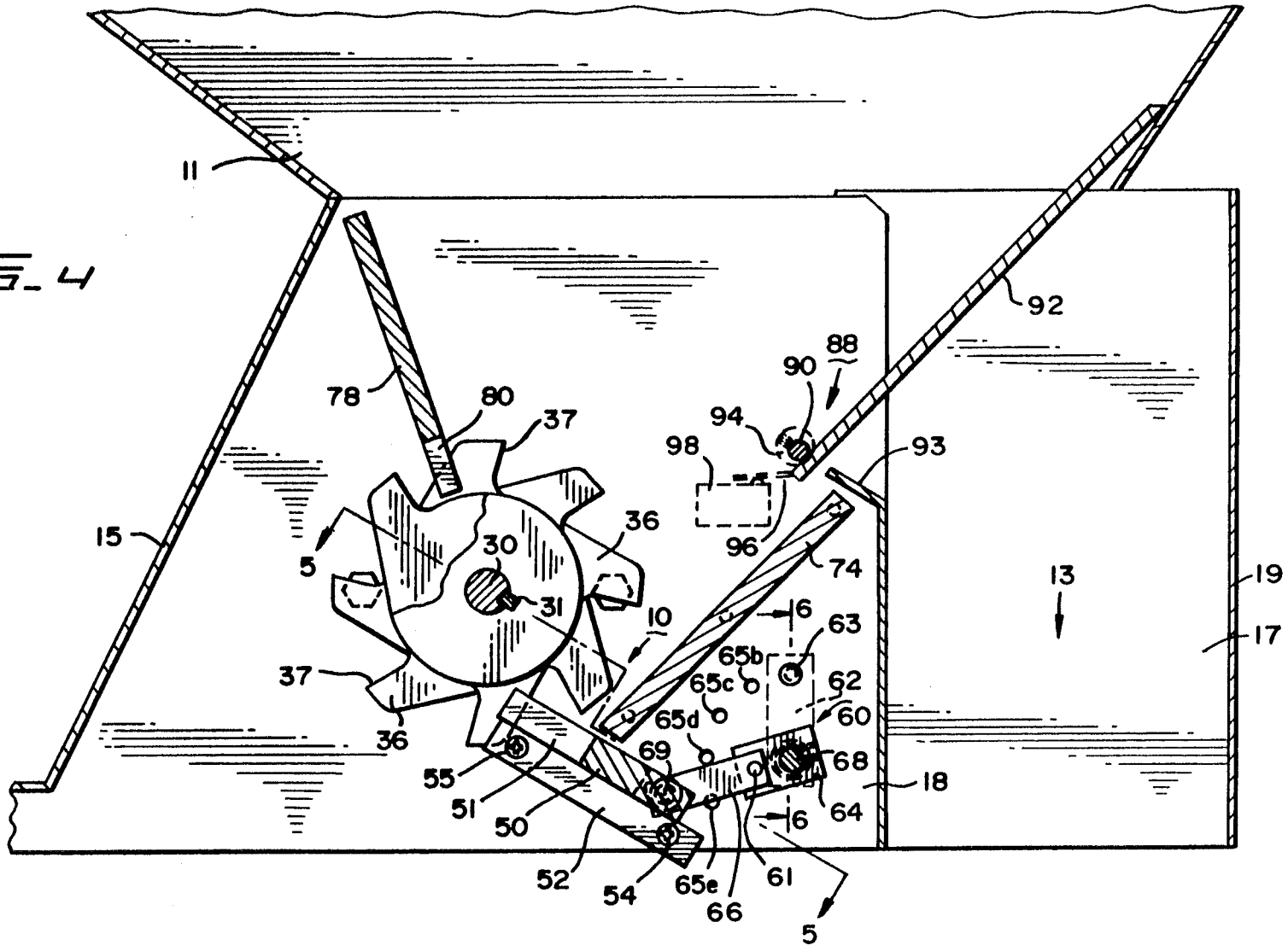
FIG. 4 is an elevational view in section taken along line 4—4 of FIG. 4.

Referring now to the drawings, an ice crusher 2 of the present invention as shown in FIG. 1 is mounted on top of ice storage bin 6 and beneath an ice maker 4. Referring to FIGS. 2 and 4, ice from ice maker 4 is funnelled into ice crusher 2 by an ice delivery hopper 11, and ice which falls from hopper 11 may be directed to an ice crushing zone 10 in ice crusher 2 by a diverter plate 92, a comb plate 78, and an ice guiding plate 74. Ice is forced from crushing zone 10 through the slots 51 in a grate 50 by a plurality of crusher blades 36, which are mounted on a crusher shaft 30. The resulting crushed ice falls into ice storage bin 6 at a location directly below crushing zone 10.

Ice crusher 2 includes a frame assembly comprising a plurality of angle irons (21*a*–21*f* are shown in FIGS. 1 and 2) arranged orthogonally to form a box-like skeleton structure. The frame assembly supports a cabinet comprising a plurality of outer panels of which 7, 8, and 9 are depicted, an electric motor 20, and an internal housing 3 having a pair of sidewalls 16, 17, a pair of end walls 15, 19, and an intermediate crushing chamber wall 18.

Crusher shaft 30 is rotated through a system of belts and pulleys by an electric motor 20 which is secured to a motor base 23 through a pair of motor mountings 22, one of which is shown. As may be seen best in FIG. 2, a motor pulley 24 drives a belt 26 which in turn rotates a crusher pulley 34 which is keyed to and rotates crusher shaft 30.

Figure 3:
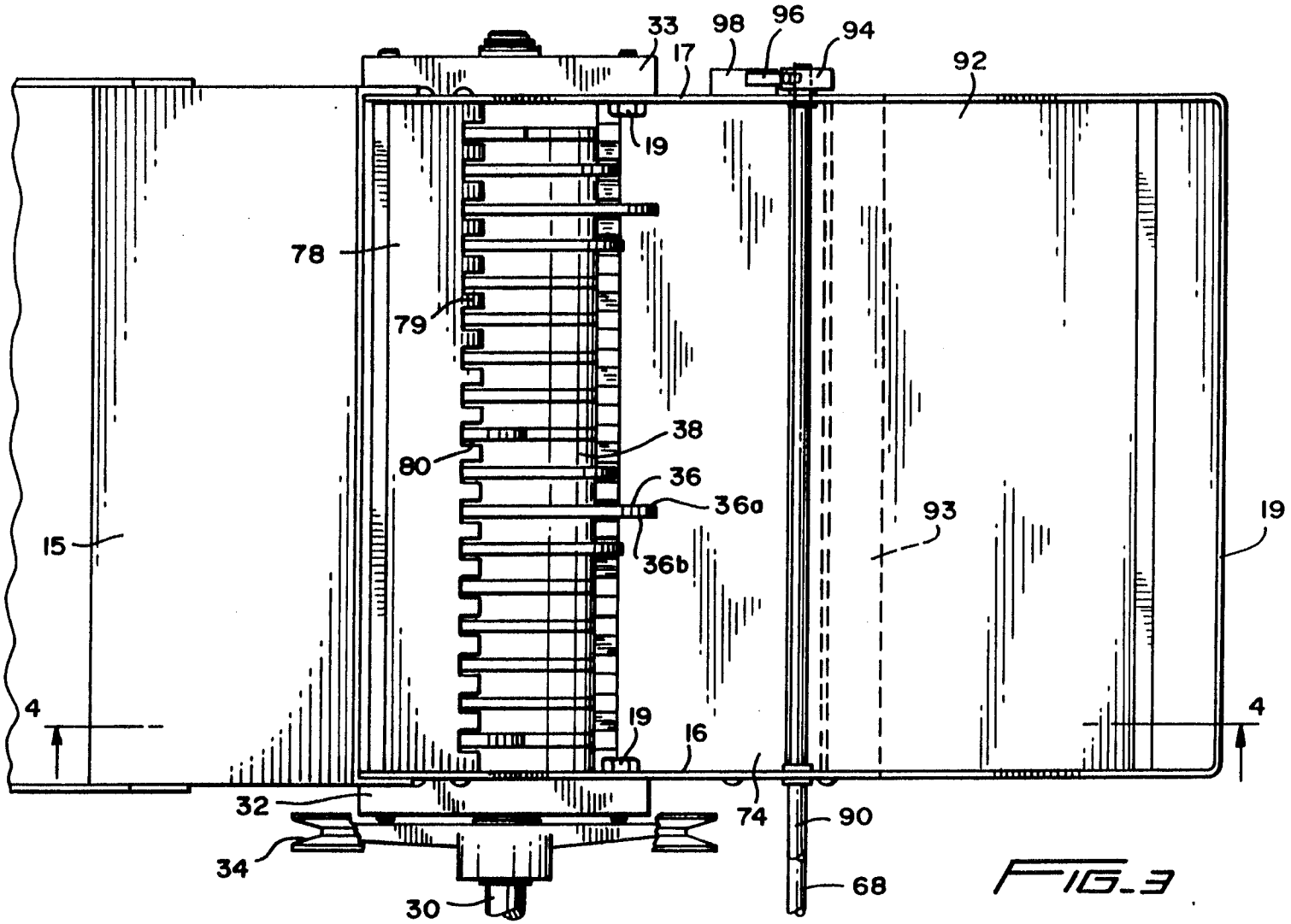
FIG. 3 is a top view of the ice crusher shown in FIG. 2.
Figure 5:
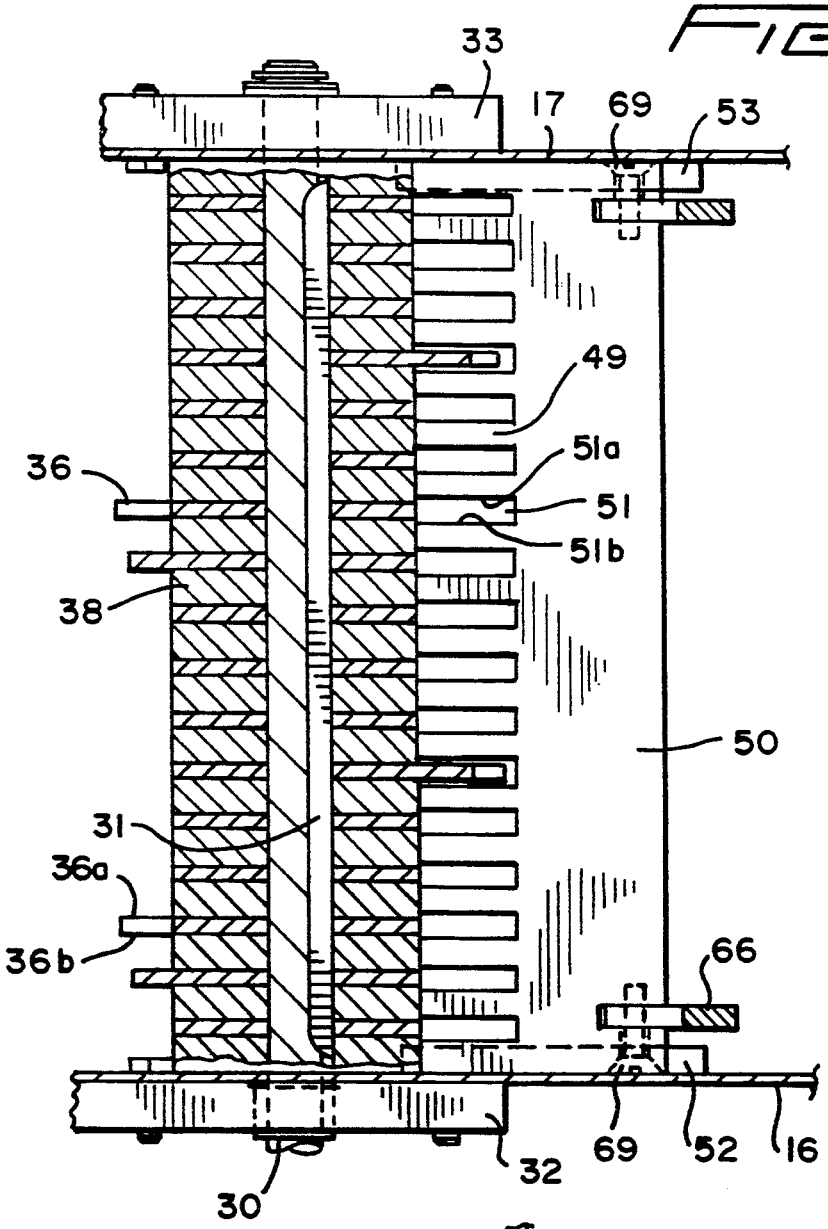
FIG. 5 is a fragmentary view in section taken along line 5—5 of FIG. 4.

Referring now to FIGS. 3 and 5, crusher shaft 30 is supported by a pair of bearing plates 32, 33 which are mounted on sidewalls 16, 17, respectively, of housing 3. A plurality of crusher blades 36 are mounted on crusher shaft 30 and keyed thereto by a key 31, which extends substantially the length of shaft 30. Crusher blades 36 are kept in spaced-apart arrangement by a plurality of crusher blade spacers 38.

In the preferred embodiment of the present invention, the crusher blades 36 are arranged on crusher shaft 30 so that the ice striking portions 37 of blades 36 are staggered in proceeding from one to another and define a helix. As is evident from the embodiment shown in FIGS. 2–5, adjacent blades are most preferably displaced about 45° apart. Although other angular displacements may be used, an angular displacement between about 30° and about 60° is preferred. Such a displacement of blades 36 with respect to each other has the advantages that it tends to distribute ice linearly in a manner similar to movement of material by a screw conveyor, which reduces the force required to crush the ice and improves the speed of crushing by not having all the ice engaged by the same crushing blades 36 even if all the ice falls at the same place along the length of shaft 30.

Crushing grate 50 is provided with a plurality of projecting fingers 49 defining a series of slots 51 which have a width great enough to provide a small clearance, for example, in the range of about ⅛ inch to ⅜ inch, more preferably about ¼ inch, between each side 51*a*, 51*b* of slots 51 and the corresponding edges 36*a*, 36*b* of crusher blades 36. Crushing grate 50 is supported near its outer ends by a pair of rails 52, 53, which are secured to housing sidewalls 16 and 17, respectively, by screws 54, 55. Grate 50 is movable along rails 52, 53 for changing the clearance between the inner ends of slots 51 of crusher grate 50 and the distal ends of striking portions 37 of crusher blades 36.

Figure 6:
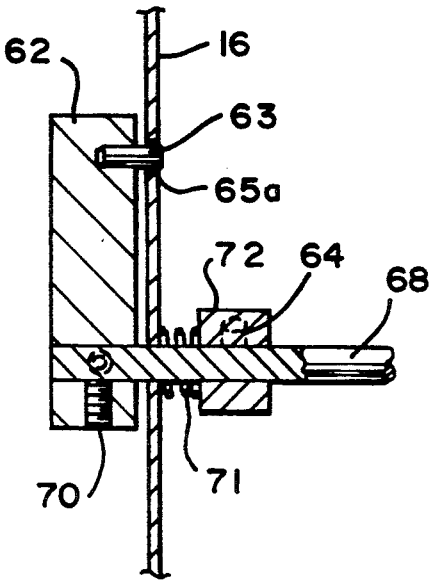
FIG. 6 is a fragmentary view in section taken along line 6—6 of FIG. 4.

The assembly 60 depicted in FIG. 4 of the drawings is provided to change this clearance and consists of an arm 62 and a lever 64 which are each secured to a rotatable rod 68 by set screws 70, 72, respectively, as shown in FIG. 6. Arm 62 is held in place in any one of apertures 65*a*–65*e* by a pin 63. Pin 63 is retained in the selected one of apertures 65*a*–65*e* by the force of a spring 71 which is transmitted to rod 68 through lever 64. Inward movement of the rod 68 against the force of spring 71 by moving a knob 67 inwardly (see FIG. 1) also moves arm 62 inwardly for releasing pin 63 from aperture 65*a*, thus permitting rod 68, arm 62 and lever 64 to rotate. A link 66 is pivotally connected at one end to lever 64 by a pin 61 and at the other end to crusher gate 50 by a pin 69. As shown in FIG. 4, counterclockwise rotation of the assembly of knob 67, rod 68, arm 62 and lever 64 pulls grate 50 downwardly and increases the clearance between crusher blades 36 and the bottom of grate slots 51, and thus increases the particle size of the crushed ice. This arrangement provides a simple, positive and effective means for adjusting the particle size of crushed ice provided by the crusher.

Ice crusher 2 is provided with an ice diverter assembly 88 for directing ice from ice maker 4 either to the ice crushing zone 10 of ice crusher 2, as shown in FIG. 4, or to an ice chute 13, as shown in FIG. 2, thus bypassing ice crushing zone 10. Ice diverter assembly 88 comprises a diverter plate 92 secured to a shaft 90, which is rotatable from the position shown in FIG. 2 to the position shown in FIG. 4 by turning a handle 91 at the front of the ice crusher cabinet. When in its diverting position as shown in FIG. 2, diverter plate 92 cooperates at its lower end with a lip 93 projecting inward from the top of intermediate wall 18 to bypass crushing zone 10 by directing all ice from the ice maker into the uncrushed ice chute 13. A microswitch 98 is mounted on sidewall 17 and is activated by a cam element 94 which presses against an actuator arm 96 when diverter plate 92 is rotated out of its diverting position. Diverter assembly 88 thus provides a means for activating electric motor 20 when diverter plate 92 is in a position to direct ice into crushing zone 10.

Referring now to FIGS. 3 and 4, a comb plate 78 having a plurality of teeth 79 defining a series of slots 80 is secured to housing sidewalls 16, 17 and positioned between ice delivery hopper 11 and the crusher blades 36 adjacent to end wall 15. Comb plate 78 serves to help direct ice from the corresponding end of ice hopper 11 into crushing zone 10.

Figures 7, 8:
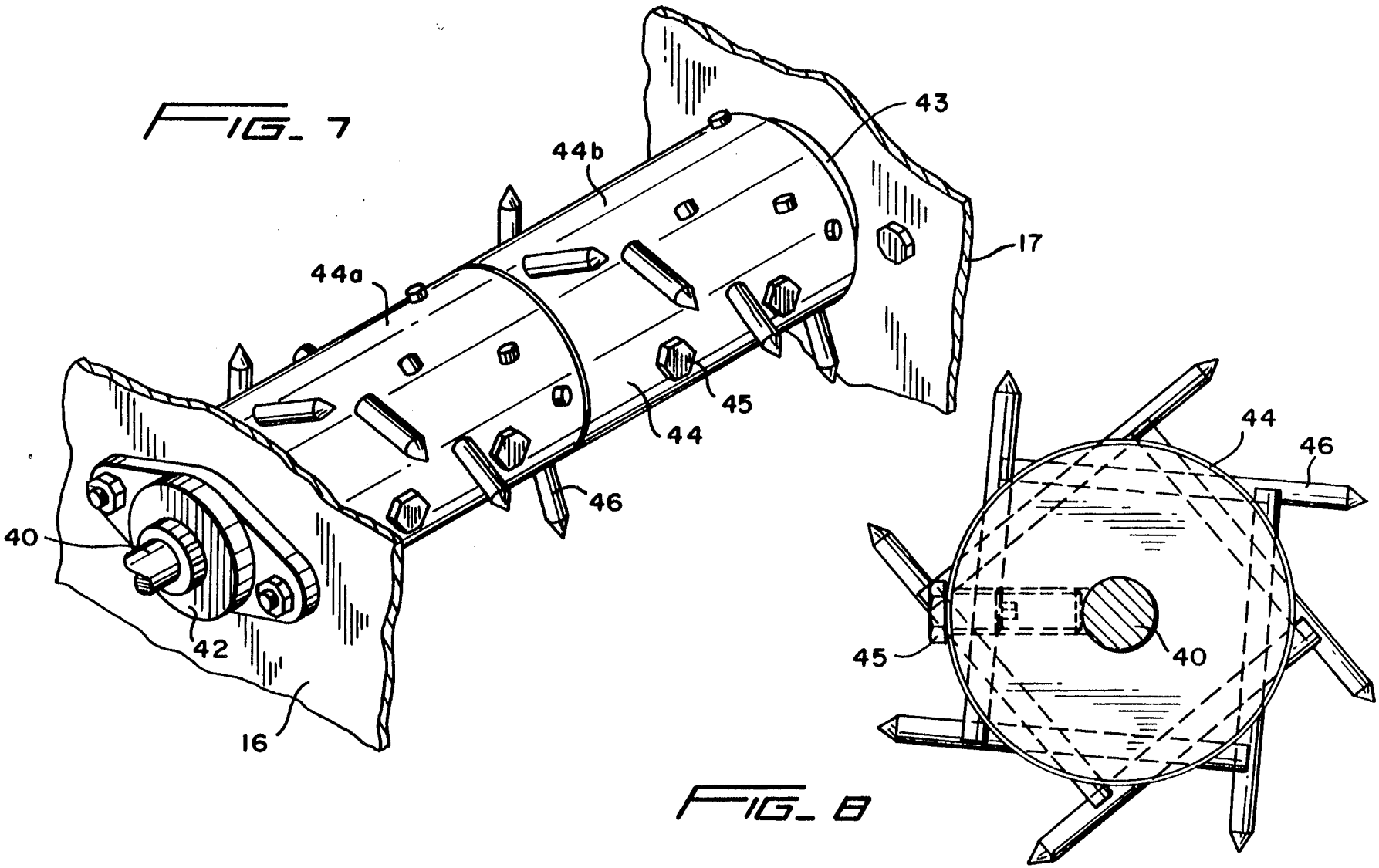
FIG. 7 is a perspective view of a modified crushing member for use in the ice crusher of the present invention.
FIG. 8 is an end view in section of the ice crushing member of FIG. 7.
Figure 9:
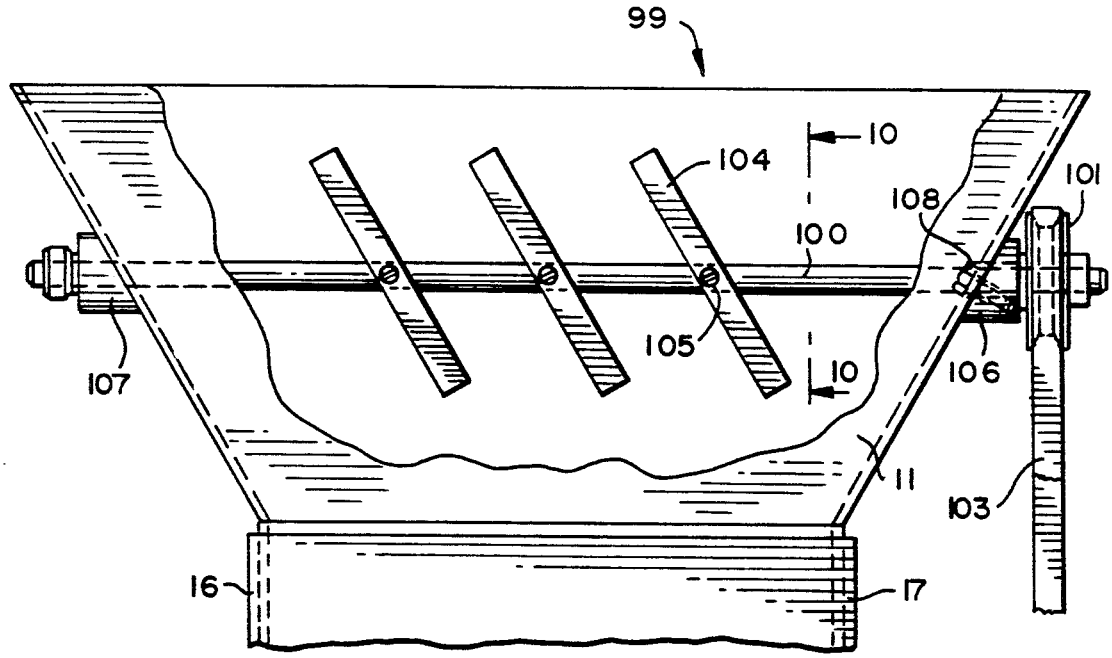
FIG. 9 is a fragmentary view of an optional mechanism for breaking sheets of ice prior to its being crushed, which may be incorporated into the ice crusher of the present invention.
Figure 10:
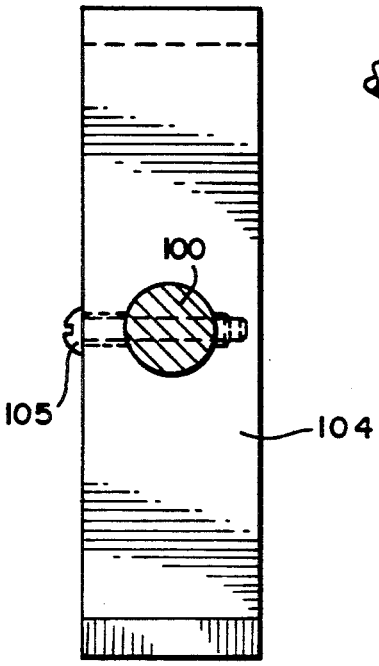
FIG. 10 is a sectional view of the ice breaking mechanism taken along line 10—10 of FIG. 9.
Figure 11:
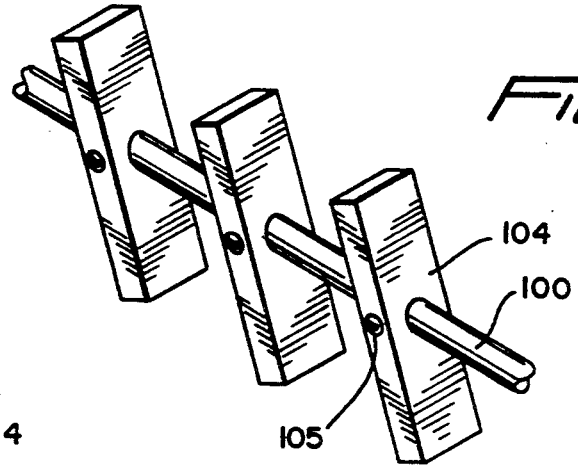
FIG. 11 is a perspective view of the ice breaking elements of FIG. 9.

FIGS. 7 and 8 show a modification of the rotating crushing member in which a plurality of picks 46 are secured to the drum of a crusher rotor 44 and are spaced to pass sequentially through slots 51 in crushing grate 50. The sequential positioning of picks 46 also preferably defines a helix and the picks may be staggered at the same angular displacements as portions 37 of blades 36. As seen in FIGS. 7 and 8, the drum of crusher rotor may comprise a plurality of segments, such as 44*a* and 44*b*, each of which is centered on a crusher rotor shaft 40 and held in position by a plurality of bolts 45 which also serve to transmit rotational force between rotor shaft 40 and crusher rotor 44. Crusher rotor 44 is provided with a pair of spacers 43 (only one spacer being shown) for separating the rotor from sidewalls 16 and 17. Shaft 40 rotates within a bearing block 42 and a similar bearing block (not shown) on the outer surface of sidewall 17.

In a preferred embodiment of the present invention, an ice breaker assembly is provided in the upper portion of ice crusher 2, as shown in FIGS. 1 and 9–11. The ice mounted on a bar drive shaft 100 and secured in spaced-apart relationship thereon by a plurality of bolts 105. Drive shaft 100 is mounted in bushings 106, 107 and rotated by a pulley 101 which is driven by a belt 103. As shown in FIG. 1, a pulley 102 is mounted on ice crusher shaft 30 for driving pulley 101.

As should be recognized, the operation of ice crusher 2 may be independent of the operation of ice maker 4, inasmuch as the operation of the former may be dependent only on the position of diverter plate 92, which has a cam element that presses against actuator arm 96 of microswitch 98 when it is positioned as shown in FIG. 4. The operation of ice crusher 2 also may be interrelated with operation of ice maker 4 by electrical and/or electronic controls, such as those shown in FIGS. 12 and 13 and described in detail below.

An electronic control system for the ice crusher 2 is now described with reference to FIGS. 1, 12 and 13. Shown electrically connected to electric motor 20, by wire 110, is a container 112 attached to outer panel 7 at the rear of the cabinet. Container 112 contains the printed circuit board 114 on which are mounted electronic components for controlling the operation of ice crusher 2. The power for energizing the components on printed circuit board 114 and operating electric motor 20 is provided by electrical connection 116, which for this embodiment comprises an A/C input of 115 volts, 60 hertz at single phase. It should be appreciated that a 230 A/C line voltage may also be used. A third connection 118 electrically connects printed circuit board 114 to at least one hot gas solenoid valve, which is provided in ice maker 4 as described below and whose function is to detect when ice maker 4 is about to start a "harvest cycle" whereby newly formed ice is to be dropped into ice hopper 11. A wire 111 provides grounding for electric motor 20.

Figure 12:
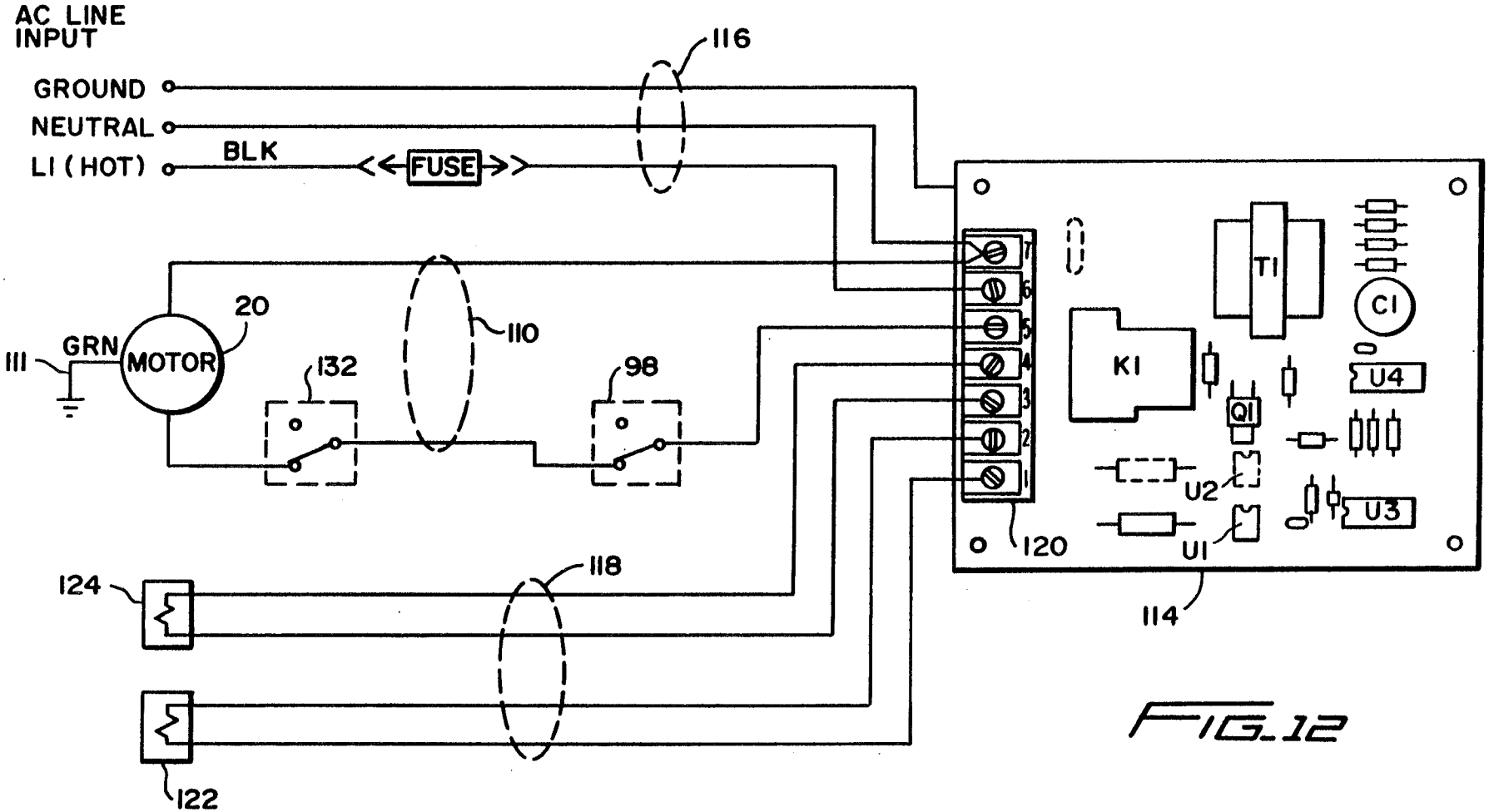
FIG. 12 is a simplified schematic of the wiring diagram of the ice crusher of the present invention which includes the printed circuit board on which the different electronic components are mounted.

With reference to FIG. 12, printed circuit board 114 is shown as having a number of electronic and electrical components, which are discussed in detail below with reference to FIG. 13, soldered thereto. Printed circuit board 114 has, for this embodiment, seven connectors on junction block 120 to which electrical connections are made to the electrical power, electric motor 20 and the two hot gas solenoid valves 122 and 124. In particular, junction connectors 1 and 2 provide an electrical circuit to hot gas solenoid valve 122; junction connectors 3 and 4 provide an electrical circuit to hot gas solenoid valve 124; junction connectors 5 and 7 provide an electrical circuit for electric motor 20; and junction connectors 6 and 7 provide input from the A/C power source.

Figure 13:
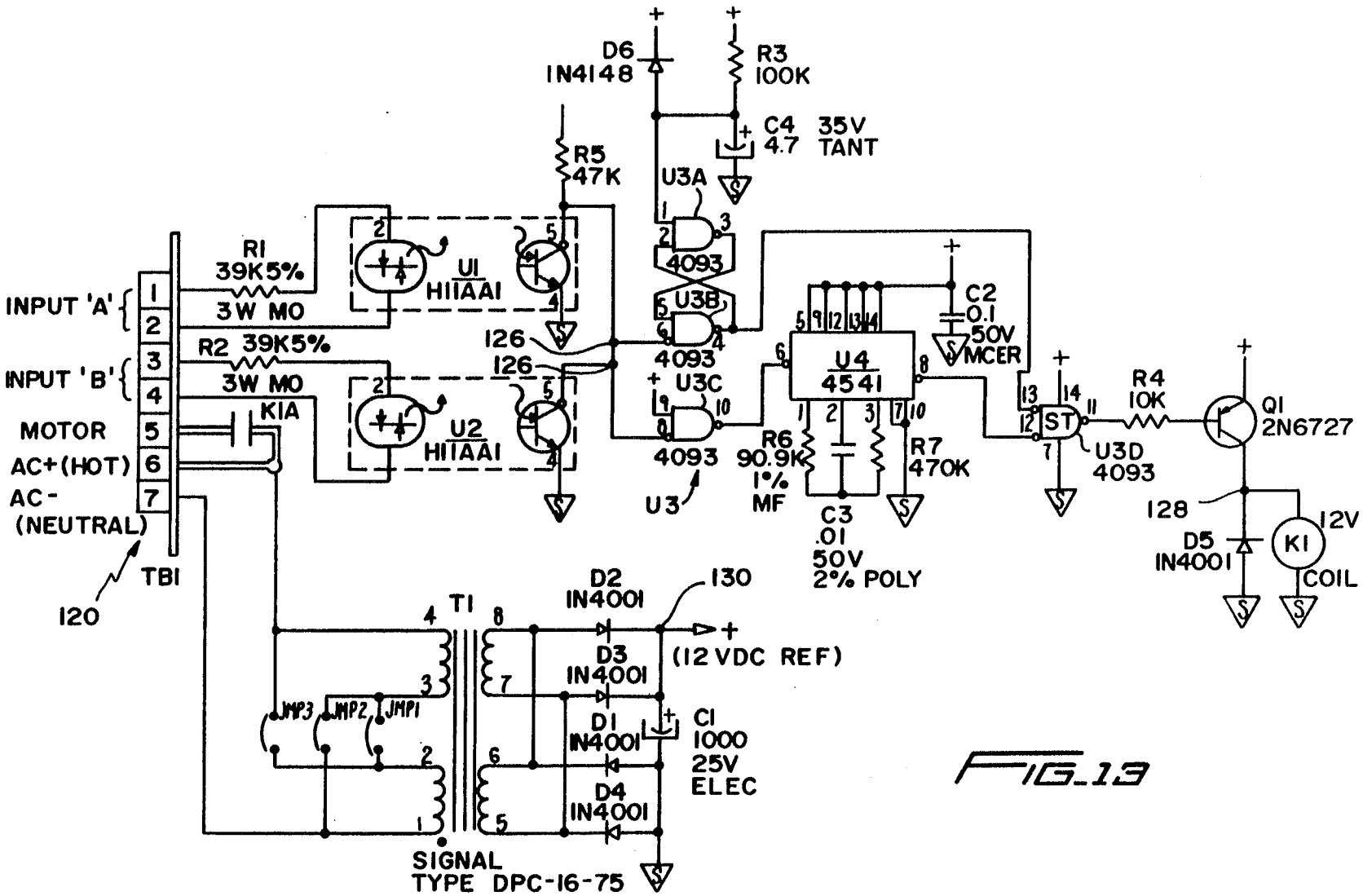
FIG. 13 is a schematic diagram of the electrical circuit for the operation of the ice crusher of the present invention.

The schematic of the electrical circuit representing the components mounted on printed circuit board 114 is illustrated in FIG. 13. Junction connectors 1, 2, 3, and 4, which carry signals from hot gas solenoid valves 122 and 124, are connected to corresponding opto-isolators U1 and U2, which are conventional electrical devices having manufacturer type designation H11AA1. Opto-isolators U1 and U2 work in conjunction with corresponding resistors R1 and R2 to translate the respective inputs A and B from an A/C line level to the required operational D/C level of the circuit. Opto-isolators U1 and U2 further isolate the rest of the components of the circuit from the input A/C signals. Resistors R1 and R2 are current limiting resistors which limit the current flow through the diode sections of opto-isolators U1 and U2.

The outputs of opto-isolators U1 and U2, at respective pins 5 thereof, are connected to a "pull-up" resistor R5, which establishes a high logic level at nodes 126,126 when a low level "reset" is not being provided at either of output pins 5 of opto-isolators U1 and U2.

Nodes 126,126 are connected to pin 6 of NAND gate U3B and pin 8 of NAND gate U3C. As shown, NAND gates U3A and U3B are configured as a latch which acts to prevent inadvertent operation of electric motor 20 when the system is first turned on. The U3A and U3B latch is reset upon receipt of a low level "reset" signal provided by either of opto-isolators U1 and U2 at nodes 126,126. Gates U3A, U3B, U3C and U3D are part of a conventional quad 2-input NAND Schmitt trigger IC chip U3 which is manufactured for example by RCA under manufacturer designation 4093.

Gate U3C acts as a logic level inverter for providing a signal at its output pin 10 to input pin 6 of a resetable programmable timer IC chip U4, which performs the timing function of the system and has manufacturer designation 4541. The clock frequency of timer IC chip U4 is determined by timing resistors R6, R7 and timing capacitor C3. A bypass capacitor C2 connecting timer IC chip U4 to ground prevents current spikes generated by IC chip U4 from affecting the other components of the system.

NAND gate U3D is one of the gates of quad 2-input Schmitt trigger IC chip U3 and is used as a switch for conditionally turning on relay K1, via transistor Q1, when the logic level at its input pins 12 and 13 are not both high.

The output of gate U3D, at pin 11, is connected to the input of PNP transistor Q1, via resistor R4, which limits the current flow through the base-emitter junction of transistor Q1. The collector of transistor Q1 is connected at junction 128 to both relay K1 and a diode D5, which is a "free-wheeling" diode connected across the coil of relay K1 to clamp any "fly back EMF" when relay K1 is turned off. Transistor Q1, diode D5 and relay K1 are conventional electronic components.

A/C power is provided to junction connectors 6 and 7, and subsequently to a transformer T1. Depending on how jumpers JMP1, JMP2 and JMP1 are connected across the primary windings, transform T1 may be configured for either 120 volt A/C or 240 volt A/C operation. A 120 volt A/C is provided to the primary windings of transformer T1 for this embodiment. The A/C voltage at the secondary windings of transformer T1 is rectified by diodes D1 to D4 to provide a 12 volt D/C voltage at node 130, which is used by the other electronic and electrical components of the system.

In addition to the electrical circuit shown in FIG. 13, as is well known, for typical ice making machines, there is a bin thermostat (not shown) that is electrically connected to ice maker 4 and mounted within ice storage bin 6 for determining how much ice is available in the bin. In particular, for the present invention embodiment, the bin thermostat comprises sensing bulbs that are placed in both ice cube and crushed ice sections of ice storage bin 6.

In the instance where diverter plate 92 has been set to the position shown in FIG. 2 whereby ice from the ice maker is directed into the uncrushed ice chute 13, then into the appropriate section of the ice storage bin 6, the sensing bulb of the bin thermostat will provide a signal to ice maker 4 to instruct it to stop producing ice if that section of storage bin 6 is sensed as filled with uncrushed ice. Likewise, if diverter plate 92 has been positioned as shown in FIG. 4, the sensing bulb of the bin thermostat in the crushed ice section of storage bin 6 will send a signal to ice maker 4 to instruct it to stop production of ice if that section of the storage bin is filled. As is common for both sensing bulbs, once either senses that additional ice is needed in the corresponding section of the ice storage bin, a signal is sent to ice maker 4 to instruct it to start producing ice.

As is well known, there may be conventionally located within ice maker 4 one or more hot gas solenoid valves, such as valves 122 and 124 shown in FIG. 12.

This embodiment contemplates that two ice makers are piggybacked one on top of the other, each of the ice makers having a corresponding one of the hot gas solenoid valves 122 and 124. In essence, the circuitry for a hot gas solenoid valve detects when the ice maker has sufficiently converted water to ice to begin a "harvest cycle" whereby the formed ice in ice maker 4 is deposited into ice delivery hopper 11. For the sake of clarity and since it is conventional, the circuitry of the ice maker that energizes and deenergizes the hot gas solenoid valve is not shown. For the discussion of the present invention embodiment, it is only necessary to realize that when the hot gas solenoid is energized, a signal is sent to the electrical circuit of FIG. 13. Conversely, when the hot gas solenoid valve is deenergized, no signal is sent.

With reference to FIGS. 12 and 13, the electrical operation of ice crusher 2 is as follows. Assume that electrical power switch 132 (FIG. 12) for the ice crusher 2 has been turned on. Further assume that diverter plate 92 has been diverted to its diverting position as shown in FIG. 2 such that cam element 94 presses against actuator arm 96 of microswitch 98. At this time, as shown in FIG. 12, a complete circuit is formed for electrical circuit 110 and the circuit of FIG. 13 is activated.

Insofar as both hot gas solenoid valves 122 and 124, and their corresponding opto-isolators U1 and U2, operate in the same manner, only hot gas solenoid valve 122 and its corresponding opto-isolator U1 will be discussed.

When the circuit of FIG. 13 is first activated, assuming that hot gas solenoid valve 122 has not detected the beginning of a harvest cycle in ice maker 4, no signal is sent to input A by the solenoid valve circuit. Accordingly, a logic low "power on pulse" signal is present at node 126. This logic low signal is input to the latch comprising NAND gates U3A and U3B, at pin 6 of gate U3B, for the duration as determined by the RC constant of resistor R3 and capacitor C4. When the latch is thus set, a logic low is likewise present at input pin 13 of gate U3D which forces output pin 11 to a logic high state, thereby preventing PNP transistor Q1 from conduction. As a consequence, relay K1 remains inoperative. As long as no logic high signal is present at node 126, the output logic from the latch would remain low and relay K1 remains inactive.

When hot gas solenoid valve 122 senses the beginning of a harvest cycle, i.e., when ice maker 4 is ready to deposit its formed ice into delivery hopper 11, an A/C signal is sent thereby to input A. This A/C signal is current limited by resistor R1 and fed to the input diode portion of opto-isolator U1. From there the A/C signal is translated into a D/C signal and fed as a logic high state to node 126. Upon receipt of this "harvest" signal, the latch is reset, if the duration of RC constant has not already lapsed so that the latch is not already reset; and a logic high signal is provided as an output from pin 4 of gate U3B to input pin 13 of gate U3D.

At the same time, the reset logic high signal is provided as an input to pin 8 of gate U3C. This signal is inverted and provided as a logic low signal at output 10 and fed to input pin 6 of resetable programmable timer chip U4, which causes timer chip U4 to provide a logic enable signal at its output pin 8 to input pin 12 of gate U3D. With both input pins 13 and 12 at logic high states, the output of gate U3D at pin 11 becomes a logic low state to thereby effect transistor Q1 to conduct. As a consequence, relay K1 is energized to drive electric motor 20 to begin turning crusher pulley 34 and thereby blades 36 to crush the ice as it is harvested by the ice maker.

As long as hot gas solenoid valve 122 continues to detect a harvest condition in ice maker 4, an A/C signal is fed thereby to opto-isolator U1 and crusher electric motor 20 will continue to operate.

At the end of the harvest cycle, hot gas solenoid valve 122 is deenergized and the A/C signal is no longer provided as an input to opto-isolator U1. At this time, a logic low state is again present at node 126 and input pin 8 of gate U3C. In other words, the reset signal is now absent at node 126 and, as a consequence, a logic high signal is provided at output pin 10 of gate U3C to input pin 6 of timer chip U4.

With the reset signal absent, timer chip U4 begins to initiate its predetermined timing interval, preset by timing resistors R6, R7 and capacitor C3. During this preset RC time duration, the logic enable signal at output pin 8 of timer chip U4 is maintained so that relay K1, and therefore electric motor 20, remain energized. This time delay in which the ice crusher electric motor is kept running is desirable in that it allows sufficient time for all the freed ice remaining in the ice maker and in the delivery hopper of the ice crusher to be crushed and delivered to the ice bin. For the circuit of FIG. 13, a delay of approximately 1 to 1 ½ minutes after the hot gas solenoid valve 122 has been deenergized is deemed to provide sufficient time for electric motor 20 to crush all the ice remaining in the hopper.

At the end of the RC delay time interval, the signal at output pin 8 of timer chip U4 changes state. As a consequence, the signal at output pin 11 of gate U3D becomes logic high to thereby turn transistor Q1 off. Subsequently, relay K1 is deenergized and the operation of electric motor 20 is terminated.

The material from which the various components are made is not critical and suitable materials may readily be selected by workers in the art. Steel alloys, such as stainless steel, are well-suited for the cabinet, housing, shafts and the ice crushing elements, while plastic materials such as high density polyethylene are suitable for the ice diverting and guiding members, such as the ice hopper, ice chute walls and rails for the grate.

The embodiments described herein are for the purpose of illustrating the present invention, and workers skilled in the art will recognize other variations thereof within the scope of this invention, which is limited only by the claims presented hereinafter and equivalents of the features described therein.

What is claimed is:

1. An ice crusher for placement between an ice maker having ice outlet means and an ice storage bin having ice inlet means, said ice crusher comprising:

housing means defining an upper ice inlet means for communicating with the ice outlet means of said ice maker, and a lower ice outlet means for communicating with the ice inlet means of said storage bin;

a crusher assembly comprising a horizontally-extending crusher rotor mounted within said housing means, a plurality of ice-crushing elements extending radically from said rotor, and a grate member mounted within said housing and having a row of spaced-apart, open-ended slots for cooperating with said ice-crushing elements in a zone for crushing ice;

means within said housing for directing ice from said upper ice inlet means to said ice crushing zone;

driving means for rotatably driving said crusher rotor;

sensing means for detecting when ice formed in said ice maker is to be freed for deposit into the ice outlet means thereof, and for outputting a corresponding detect signal as long as ice is to be freed; and, control means responsive to said detect signal for activating said driving means when said detect signal is present and deactivating said driving means when said detect signal is absent, said control means comprising time delay means responsive to a loss of said detect signal to initiate a predetermined time duration during which said driving means is kept activated and at the end of which said driving means is deactivated, said time duration being sufficient for freed ice remaining in said ice maker when said detect signal is lost to pass through said ice crushing zone.

2. An ice crusher according to claim 1 wherein said ice-crushing elements are mounted on said rotor in a staggered arrangement such that at least a portion of said ice-crushing elements pass in sequence through said slots in said grate member.

3. An ice crusher according to claim 2 wherein said ice-crushing elements are arranged so that the ice engaging portions of said elements define a pair of helixes about said crusher rotor, said helixes being substantially parallel and axially spaced relative to each other to cause ice engaged by said engaging portions to be advanced along said rotor in the direction of its axis.

4. An ice crusher according to claim 3 wherein said ice-crushing elements comprise a plurality of planar plates mounted on said rotor, the planes of said plates being substantially perpendicular to the rotor axis.

5. An ice crusher according to claim 4 wherein said plurality of plates are held in a spaced-apart relationship by a plurality of spacer elements.

6. An ice crusher according to claim 3 wherein said ice-crushing elements comprise a plurality of elongated picks mounted on a rotor drum, the axes of said picks being in planes substantially perpendicular to the rotor axis.

7. An ice crusher according to claim 1 further comprising means for adjustably mounting said grate member within said housing for movement in a radial direction with respect to said rotor, and means for adjusting the position of said grate member with respect to said ice-crushing elements to change the spacing between the bottoms of said open-ended slots and the distal ends of said ice-crushing elements, and thereby to change the particle size of the crushed ice.

8. An ice crusher according to claim 7 wherein said adjusting means comprises selector means pivotally mounted on said housing means, and means for causing said grate member to move toward and away from said ice crushing elements in response to pivotal movement of said selector means.

9. An ice crusher according to claim 1 wherein said directing means comprises wall means converging inward to define an inlet to said ice crusher assembly, and wherein said ice crusher further includes breaker means positioned between said upper ice inlet means and said crusher assembly inlet and comprising a rotatable shaft mounted on said housing means, a plurality of spaced-apart ice striking bars mounted on said shaft and having end portions arranged to strike against a sheet of ice entering said upper ice inlet means to break up said sheet ice by direct impact, and means for rotating said shaft so that said end portions break up said sheet ice before said sheet ice reaches said crusher assembly inlet.

10. An ice crusher according to claim 9 wherein said shaft rotating means comprises means for rotatably connecting said shaft to said crusher rotor so that rotation of said crusher rotor by said driving means causes rotation of said breaker shaft.

11. An ice crusher according to claim 1 wherein said driving means for rotatably driving said crusher rotor is an electric motor which is energized and deenergized by said control means.

12. An ice crusher according to claim 11 further comprising:

selector means pivotally mounted on said housing for directing ice from said ice maker either to said ice crushing zone or directly to the ice inlet means of said ice storage bin; and, electrical switch means arranged to be operated by said selector means and electrically connected to said control means for permitting said motor to be energized only when said selector means is positioned to direct ice to said crusher assembly.

13. An ice crusher according to claim 1, wherein said control means further comprises:

means for converting said detect signal to a reset signal; and, latch means responsive to said reset signal for outputting a trigger signal to activate a relay means for energizing said driving means.

14. An ice crusher according to claim 13, wherein said time delay means is electrically connected to said converting means and responsive to the absence of said reset signal to initiate a predetermined time duration at the end of which a signal is sent to deactivate said relay means and thereby to deenergize said driving means.

15. An ice crusher according to claim 14 wherein said time delay means comprises an integrated circuit chip in which said predetermined time duration is determined by a RC circuit, and wherein said converting means comprises at least one opto-isolator.

16. An ice crusher according to claim 1, further comprising:

selector means pivotally mounted on said housing for directing ice from said ice maker either to said ice crushing zone or directly to the ice inlet means of said ice storage bin; and, switch means arranged to be operated by said selector means for deactivating said control means when said selector means is positioned to direct ice directly to the ice inlet means of said ice storage bin.

* * * * *